US010458005B2

(12) United States Patent
Sugahara

(10) Patent No.: US 10,458,005 B2
(45) Date of Patent: Oct. 29, 2019

(54) HEAT-RESISTANT AND CORROSION-RESISTANT HIGH-CHROMIUM NICKEL-BASED ALLOY WITH SUPERIOR HOT FORGEABILITY

(71) Applicant: HITACHI METALS, LTD., Tokyo (JP)

(72) Inventor: Katsuo Sugahara, Tokyo (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 16/076,652

(22) PCT Filed: Feb. 22, 2017

(86) PCT No.: PCT/JP2017/006656
§ 371 (c)(1),
(2) Date: Aug. 8, 2018

(87) PCT Pub. No.: WO2017/159256
PCT Pub. Date: Sep. 21, 2017

(65) Prior Publication Data

US 2019/0062877 A1 Feb. 28, 2019

(30) Foreign Application Priority Data

Mar. 15, 2016 (JP) ..... 2016-050512

(51) Int. Cl.
*C22C 19/05* (2006.01)
*F22B 37/04* (2006.01)
*C22F 1/10* (2006.01)

(52) U.S. Cl.
CPC ..... *C22C 19/052* (2013.01); *C22C 19/05* (2013.01); *C22F 1/10* (2013.01); *F22B 37/04* (2013.01)

(58) Field of Classification Search
CPC ..... C22C 19/052; C22F 1/10
See application file for complete search history.

(56) References Cited

U.S. PATENT DOCUMENTS

| | | | |
|---|---|---|---|
| 3,519,419 | A | 7/1970 | Gibson et al. |
| 2016/0333444 | A1 | 11/2016 | Sugahara |

FOREIGN PATENT DOCUMENTS

| | | | |
|---|---|---|---|
| JP | 51002413 | B | 1/1976 |
| JP | 06094579 | B | 11/1994 |
| JP | 11217657 | A | 8/1999 |
| JP | 2005240052 | A | 9/2005 |
| JP | 2008291281 | A | 12/2008 |
| JP | 2009052084 | A | 3/2009 |
| JP | 2014145107 | A | 8/2014 |
| JP | 2014145108 | A | 8/2014 |
| WO | 2015/129063 | A1 | 9/2015 |

OTHER PUBLICATIONS

International Search Report corresponding to International Application No. PCT/JP2017/006656 dated May 23, 2017.

*Primary Examiner* — Jessee R Roe
(74) *Attorney, Agent, or Firm* — Myers Bigel, P.A.

(57) ABSTRACT

Provided is a heat-resistant and corrosion-resistant high-Cr-containing Ni-based alloy having superior hot forgeability, consisting of, by mass %, 43.1 to 45.5% of Cr, 0.5 to 1.5% of Mo, 0.0001 to 0.0090% of Mg, 0.001 to 0.040% of N, 0.05 to 0.50% of Mn, 0.01 to 0.10% of Si, 0.05 to 1.00% of Fe, 0.01% to 1.00% of Co, 0.01 to 0.30% of Al, 0.04 to 0.3% of Ti, 0.0003 to 0.0900% of V, 0.0001 to 0.0100% of B, 0.001 to 0.050% of Zr, and optionally one or more elements selected from (a) to (d): (a) 0.001 to 0.020% of Cu; (b) 0.001 to 0.100% of W; (c) 0.0001 or more and less than 0.0020% of Ca; and (d) 0.001% or more and less than 0.100% of Nb, and the balance of Ni with inevitable impurities.

18 Claims, No Drawings

HEAT-RESISTANT AND CORROSION-RESISTANT HIGH-CHROMIUM NICKEL-BASED ALLOY WITH SUPERIOR HOT FORGEABILITY

RELATED APPLICATIONS

This application is a 35 U.S.C. § 371 national phase application of PCT Application PCT/JP2017/006656 filed Feb. 22, 2017, which claims priority to Japanese Application No. 2016-050512 filed Mar. 15, 2016. The entire contents of each are incorporated herein by reference in its entirety.

FIELD OF THE INVENTION

The present invention relates to a heat-resistant and corrosion-resistant high-Cr-containing Ni-based alloy having superior hot forgeability, and in particular, relates to a heat-resistant and corrosion-resistant high-Cr-containing Ni-based alloy having superior hot forgeability, suitable for forming a part required to be a large product that requires corrosion resistance against a high temperature corrosion environment including sulfuration, such as a waste gas environment of a power generation boiler using heavy oil or coal as a fuel, or suitable for forming a large reaction vessel required in a chemical plant for manufacturing pharmaceutical intermediates or the like.

BACKGROUND OF THE INVENTION

Conventionally, a high-Cr-containing Ni-based alloy that contains Cr near the solid solubility limit of Ni has been known as a heat-resistant alloy having high temperature corrosion resistance, and as a corrosion-resistant alloy having corrosion resistance, demonstrating very high performance in each of these aspects.

For example, such an alloy has been used to make a metal member for use in a waste gas environment of a boiler for thermal power generation in which fossil fuel, such as heavy oil and coal is burned, making use of an advantageous characteristic of high temperature corrosion resistance.

Furthermore, in order to improve power generation efficiency, such a boiler for thermal power generation in which fossil fuel, such as heavy oil and coal, is burned, has been improved to increase a vapor temperature inside a boiler tube. The boiler tube itself has a temperature lower than the ambient temperature because the boiler tube is externally reheated by a combustion waste gas, so that a metal member directly contacting with the boiler tube is cooled by the boiler tube, resulting in reduction in high temperature corrosion.

However, since a vapor temperature passing through the boiler tube is increasing, erosion caused by high temperature corrosion including sulfuration increases markedly. In such a situation, a 50Ni-50Cr alloy, which is known to have superior sulfuration resistance, has been employed to form a supporting member of the boiler tube.

However, the 50Ni-50Cr alloy has low workability, so that it cannot be subjected to hot forging and is provided as a cast product. However, because such a product is a cast, there are limitations on its shape, and cold workability in bending, for example, is also insufficient.

For example, an alloy having a composition near that of the 50Ni-50Cr alloy and developed in view of the demand for improved workability is a "corrosion-resistant Ni—Cr-based alloy having superior bend formability" disclosed in Patent Document 1.

This alloy can be subjected to hot forging and has superior cold workability, so that this alloy can be formed into a bent shape for controlling a waste gas flow pass.

However, although the "corrosion-resistant Ni—Cr-based alloy having superior bend formability" disclosed in Patent Document 1 barely enables hot forging of a cast, hot workability is poor, so that it is difficult to form into a shape such as a seamless pipe, which is required to be shaped at high temperature, and additional problems such as poor corrosion resistance of a welded portion occur.

Furthermore, Patent Document 2 proposes a 50Ni-50Cr alloy with hot workability improved by controlling alloy component contents, in particular, the content of Ca, Mg, B, rare earth elements, and Zr. However, mechanical properties, corrosion resistance and the like of this alloy are still not sufficient, and accordingly, fields of application in industrial use are limited.

Then, a "Ni-based alloy having superior high temperature workability and having superior corrosion resistance with a significantly small elution amount of metal ions" was developed, as disclosed in Patent Document 3. Thus, the hot workability was improved and the corrosion resistance of a welded portion was also improved, resulting in increased convenience, so that it is possible to cope with complicated shapes.

Furthermore, Patent Document 4, "Ni-based alloy anti-corrosion plate having superior high temperature corrosion resistance", discloses that high-Cr-containing Ni-based alloy exhibits superior hot temperature corrosion resistance in a C heavy oil-fired boiler environment.

Furthermore, "Ni-based alloy having superior corrosion resistance to hydrogen sulfide and hydrogen selenide" disclosed in Patent Document 5 is also useful in applications for a high temperature corrosion environment other than for waste gas of a boiler.

As corrosion resistant applications, alloys are used as those for forming a member for use in a reaction vessel for handling therein acids, such as pharmaceutical intermediates, or those for forming a member for use in a heat exchanger for handling therein nitric hydrofluoric acid.

Suitable applications of "corrosion-resistant Ni—Cr-based alloy having superior bend formability" disclosed in Patent Document 1 and "Ni-based alloy having superior high temperature workability and having superior corrosion resistance with a significantly small elution amount of metal ions" disclosed in Patent Document 3 include a member for handling therein nitric hydrofluoric acid, making use of an advantageous characteristic of corrosion resistance in a wet environment, and a reaction vessel member for use in a chemical plant, for example.

Patent Document 6 discloses "Ni—Cr-based alloy having superior resistance to corrosion by nitric hydrofluoric acid", and reports that a high-Cr-containing Ni-based alloy is an excellent alloy for forming a member for use in a heat exchanger handling therein nitric hydrofluoric acid.

For another example, the high-Cr-containing Ni-based alloy is also used in a member that requires high abrasion resistance, such as a "die member for resin molding" disclosed in Patent Document 7.

CITATION LIST

Patent Documents

Patent Document 1: JP H6-94579 B
Patent Document 2: JP H11-217657 A
Patent Document 3: JP 2005-240052 A Patent Document 4: JP 2014-145107 A
Patent Document 5: JP 2014-145108 A
Patent Document 6: JP 2008-291281 A
Patent Document 7: JP 2009-52084 A

SUMMARY OF INVENTION

Technical Problems

In recent years, further improvements in power generation efficiency have been required, and in such a situation, as a vapor temperature of a boiler increases, corrosion of a metal member caused by high temperature corrosion, including sulfuration, increases. Thus, the number of sites is increasing to which the high-Cr-containing Ni-based alloy, which has superior corrosion resistance against high temperature corrosion including sulfuration, is applied. For example, the amount of the high-Cr-containing Ni-based alloy used to form members, such as straightening vanes or baffles for controlling a flow of a waste gas, boiler tube supporting fittings, and the like, used for each power generation boiler, has increased several tens of times and the size of such members has also increased, as compared with those at the time when the Ni-based alloy proposed in Patent Document 3 began to be used.

For boiler member applications, a plate-shaped or bar-shaped row material is worked and shaped into a final shape. In commercial production of the plate-shaped or bar-shaped raw material, the process progresses on a molten ingot basis, so that as the size of the raw material increases, the efficiency increases. For example, in order to produce large amounts by using existing stainless-steel production lines, an ingot on the scale of at least a dozen tons is required.

Furthermore, a reaction vessel for use in a chemical plant for manufacturing pharmaceutical intermediates, in which the high-Cr-containing Ni-based alloy is used, also tends to have a large capacity with a view towards high efficiency, and the size of each member is increasing.

There is a tendency that the increases in demand for and scale of high-temperature members and reaction vessel members will continue in the future. In order to respond to such a situation, it is necessary to increase a capacity that a high-Cr-containing Ni-based alloy can be melted at a time. That is, by enlarging the size of the molten ingot, it may be possible to meet the demand for a large forged member, and to improve productivity.

However, enlarging of the size of the molten ingot might lead to a slow cooling rate at the time of melting, whereby microsegregation becomes conspicuous and a coarse solidified structure might be formed. Such a coarse solidified structure cannot be decomposed only by a homogenizing heat treatment. However, by performing hot forging to destroy the solidified structure and to perform homogenization, desired workability can be obtained. However, when the solidified structure becomes coarse, hot forgeability might decrease, so that deformability at a high temperature might significantly decrease and cracking during hot forging might easily occur, for example.

The improvement in hot workability in Patent Document 3 was evaluated with materials obtained by subjecting about 5 kg of a laboratory scale ingot, in a melted state, to a homogenizing heat treatment, followed by hot rolling to reduce the thickness of 40 mm to 30 mm, as disclosed in Examples. The hot rolling in this process exerts the same effect as that of the hot forging, and thus, it is effective for destroying the solidified structure and increasing deformability.

Although Patent Document 3 discloses that it is also possible to manufacture a seamless pipe by hot extrusion, a billet used in the extrusion is not in a melted state, but in a state in which the deformability has been increased by destroying the solidified structure by a homogenizing heat treatment and a hot forging step.

Even in Patent Document 3, if the ingot is about 1 ton, for example, it is possible to perform hot forging without problems by applying a homogenizing heat treatment immediately after melting. As the homogenization advances while performing the hot forging, hot deformability increases, so that a member having a desired shape can be finally produced.

However, there might be a problem in that when the size of the ingot becomes greater, even when the homogenizing heat treatment is performed well, cracking might occur during the hot forging because deformability is poor at the beginning of the forging.

Also in the other patent documents, Patent Documents 4 to 6, which disclose conventional techniques regarding the high-Cr-containing Ni-based alloy, there are no disclosures about how to improve the hot forgeability and the hot workability.

Solution to Problems

In view of this, the present inventor has earnestly conducted research to develop a heat-resistant and corrosion-resistant high-Cr-containing Ni-based alloy that solves such problems and has even more superior hot forgeability than a conventional one, even in a state in which the alloy includes a solidified structure, and consequently, the inventor discovered a high-Cr-containing Ni-based alloy having a composition that consists of, by mass %, 43.1 to 45.5% of Cr, 0.5 to 1.5% of Mo, 0.0001 to 0.0090% of Mg, 0.001 to 0.040% of N, 0.05 to 0.50% of Mn, 0.01 to 0.10% of Si, 0.05 to 1.00% of Fe, 0.01% to 1.00% of Co, 0.01 to 0.30% of Al, 0.04 to 0.30% of Ti, 0.0003 to 0.0900% of V, 0.0001 to 0.0100% of B, 0.001 to 0.050% of Zr, optionally consists of one or more elements selected from (a) to (d): (a) 0.001 to 0.020% of Cu; (b) 0.001 to 0.100% of W; (c) 0.0001 or more and less than 0.0020% of Ca; and (d) 0.001% or more and less than 0.100% of Nb, and the balance of Ni with inevitable impurities, and the inventor found that this alloy has superior hot forgeability and superior corrosion resistance against hot temperature corrosion including sulfuration.

The present invention has been made based on the above findings. According to a first aspect, the invention provides a heat-resistant and corrosion-resistant high-Cr-containing Ni-based alloy having superior hot forgeability, the alloy having a composition consisting of, by mass %, 43.1 to 45.5% of Cr,
0.5 to 1.5% of Mo,
0.0001 to 0.0090% of Mg,
0.001 to 0.040% of N,
0.05 to 0.50% of Mn,
0.01 to 0.10% of Si,
0.05 to 1.00% of Fe,
0.01% to 1.00% of Co,
0.01 to 0.30% of Al,
0.04 to 0.30% of Ti,
0.0003 to 0.0900% of V,
0.0001 to 0.0100% of B,
0.001 to 0.050% of Zr, and
the balance of Ni with inevitable impurities.

In a second aspect, the heat-resistant and corrosion-resistant high-Cr-containing Ni-based alloy having superior hot forgeability according to the first aspect of the present invention has the composition further consisting of, by mass %, 0.001 to 0.020% of Cu.

In a third aspect, the heat-resistant and corrosion-resistant high-Cr-containing Ni-based alloy having superior hot forgeability according to the first or second aspect of the present invention has the composition further consisting of, by mass %, 0.001 to 0.100% of W.

In a fourth aspect, the heat-resistant and corrosion-resistant high-Cr-containing Ni-based alloy having superior hot forgeability according to the first, second or third aspect of the present invention has the composition further consisting of, by mass %, 0.0001% or more and less than 0.0020% of Ca.

In a fifth aspect, the heat-resistant and corrosion-resistant high-Cr-containing Ni-based alloy having superior hot forgeability according to the first aspect of the present invention has the composition further consisting of, by mass %, 0.001% or more and less than 0.100% of Nb.

In another aspect, the present invention provides a member for a boiler of a thermal power station for use in a waste gas environment, the member made of the heat-resistant and corrosion-resistant high-Cr-containing Ni-based alloy having superior hot forgeability according to any one of the first to fifth aspects.

In a further aspect, the present invention provides a member for a corrosion-resistant pressure vessel for use in a chemical plant, the member made of the heat-resistant and corrosion-resistant high-Cr-containing Ni-based alloy having superior hot forgeability according to any one of the first to fifth aspects.

Advantageous Effects of Invention

As described above, the high-Cr-containing Ni-based alloy of the present invention has superior hot forgeability, in particular, superior hot forgeability immediately after the beginning of hot forging of such a large ingot that includes coarse α-Cr phase formed at solidification, and the alloys have superior corrosion resistance against high temperature corrosion including sulfuration and superior corrosion resistance against acids, which are equivalent to or superior to those of conventional materials. Thus, by using the high-Cr-containing Ni-based alloy of the present invention, it becomes possible to manufacture a large forged member, for example, a slab (large forged product) having a size that can be provided in a manufacturing line for stainless steel, or a large forged member required in making a large reaction vessel.

Therefore, according to the high-Cr-containing Ni-based alloy of the present invention, a slab having a size that can be provided in a manufacturing line for stainless steel, and a large forged member required in making a large reaction vessel can be provided, and accordingly, the present invention demonstrates excellent industrial effects.

DESCRIPTION OF EMBODIMENTS

Next, the reasons for the content ranges of each component element in the composition of the high-Cr-containing Ni-based alloy of the present invention will be described in detail.

Cr

Cr is effective for improving corrosion resistance against high temperature corrosion including sulfuration in a high temperature environment and corrosion resistance against acids. By forming a surface film containing mostly of $Cr_2O_3$, it becomes possible to impart the superior corrosion resistance against high temperature corrosion and the superior corrosion resistance against acids. The surface film is formed as an oxide, and to what extent NiO produced from Ni, which is the main component of the alloy, has lower proportion, and to what extent the proportion of $Cr_2O_3$ approaches 100% can indicate the degree of improvement in corrosion resistance against high temperature corrosion or corrosion resistance against acids. Thus, in order to achieve sufficient effects, 43.1% by mass or more (hereinafter, "% by mass" is simply referred to as "%") of Cr should be contained. However, if the content exceeds 45.5%, then the hot forgeability in a state in which the solidified structure is formed might significantly decrease, unfavorably. Therefore, the Cr content is set to be from 43.1 to 45.5%.

The upper limit of Cr is preferably 45.0%, and is more preferably 44.8%, whereas the lower limit of Cr is preferably 43.5%, and is more preferably 43.8%.

Mo

Mo is effective for facilitating the formation of the surface film containing mostly $Cr_2O_3$, which is essential for imparting the superior corrosion resistance against high temperature corrosion and the superior corrosion resistance against acids to the high-Cr-containing Ni-based alloy. To obtain the sufficient facilitating effect, 0.5% or more of Mo should be contained. However, if the content exceeds 1.5%, then Mo might be concentrated at dendrite boundaries in the solidified structure, so that the hot forgeability in a state in which the solidified structure has become obvious, might unfavorably decrease. Therefore, the Mo content is set to be from 0.5% to 1.5%.

The upper limit of Mo is preferably 1.4%, and is more preferably 1.2%, whereas the lower limit of Mo is preferably 0.7%, and is more preferably 0.8%.

N, Mn and Mg

By making N, Mn and Mg coexist, it is possible to reduce the formation of α-Cr phases, which might decrease the hot forgeability at 1100° C. or lower. When a coarse α-Cr phase is formed as the solidified structure, a fine α-Cr phase is also formed. The coarse α-Cr phase formed as the solidified structure does not disappear even by the homogenizing heat treatment, and becomes the principal cause of inhibition of the hot forgeability immediately after the beginning of the hot forging. When an ingot size decreases, the cooling rate increases, and accordingly, it becomes possible to reduce the coarsening, whereas when the ingot size increases, the cooling rate decreases, resulting in an unavoidable increase in occurrence of the coarse α-Cr phase, correlating with the decrease in cooling rate. After melting the ingot, the melted ingot is subjected to the homogenizing heat treatment, followed by the hot forging. Here, the fine α-Cr phase is once dissolved in a γ-Ni phase, which is the matrix, by the homogenizing heat treatment. Even in a case in which an addition of trace elements described below can successively achieve decomposition and refinement of the coarse α-Cr phase without causing forging cracking immediately after the beginning of the hot forging, which is at a temperature of 1200° C. or more, then when the forging is repeated and the temperature is gradually decreased thereby to 1100° C. or less, the dissolved fine α-Cr phase might be reprecipitated, so that the deformability might significantly decrease. In this case, by shifting an incubation period for the reprecipitation to a longer-period scale, the decrease in deformability at 1100° C. or less can be reduced.

N, Mn and Mg are effective for stabilizing the γ-Ni phase, which is the matrix, for facilitating solution of Cr, and for reducing the formation of precipitated phases, such as an α-Cr phase, in a relatively short time as in the hot forging process. These advantageous effects can maintain a good hot forgeability without cracking, without a sudden increase in deformation resistance or a sudden decrease in deformability, even in a temperature range below 1100° C. However, if the N content is less than 0.001%, then there is no effect of reducing the formation of an α-Cr phase, so that excessive α-Cr phase might be formed during the hot forging process at 1100° C. or less, resulting in the decrease in hot forgeability. On the other hand, if the content exceeds 0.040%, then nitrides are produced in a short time, so that high temperature workability might decrease, and it might be difficult to process into a member. Therefore, the content is set to be from 0.001% to 0.040%.

The upper limit of N is preferably 0.035%, and is more preferably 0.030%, whereas the lower limit of N is preferably 0.002%, and is more preferably 0.004%.

Similarly, if the Mn content is less than 0.05%, then there is no effect of reducing the formation of an α-Cr phase, resulting in decrease in hot forgeability at 1100° C. or less. On the other hand, if the content exceeds 0.50%, then the corrosion resistance against acids might decrease. Therefore, the content is set to be from 0.05% to 0.50%.

The upper limit of Mn is preferably 0.40%, and is more preferably 0.35%, whereas the lower limit of Mn is preferably 0.07%, and is more preferably 0.10%.

Similarly, if the Mg content is less than 0.0001%, then there is no effect of reducing the formation of the α-Cr phase, resulting in the decrease in hot forgeability at 1100° C. or less. On the other hand, if the content exceeds 0.0090%, then the effect of reducing the formation of the α-Cr phase might be saturated, and Mg might be concentrated in grain boundaries, resulting in the decrease in hot forgeability. Therefore, the content is set to be from 0.0001% to 0.0090%.

The upper limit of Mg is preferably 0.0080%, and is more preferably less than 0.0020%, whereas the lower limit of Mg is preferably 0.0003%, and is more preferably 0.0005%.

Note that the effects of these three elements are not equivalent to each other, and it has been found that the above effects cannot be achieved unless the three elements exist at the same time and are contained within the predetermined ranges.

Si

By adding Si as a deoxidant, oxides can be reduced, so that the deformability at high temperature, which concerns the hot forgeability, can be improved, and thus, Si is effective for decreasing the forging cracking. This effect can be achieved when 0.01% or more of Si is contained. However, if the content exceeds 0.10%, then the formation of an α-Cr phase might be facilitated, so that a sudden decrease in deformability in the hot forgeability might be caused, and thus, the forging cracking may be likely to occur. Therefore, the Si content is set to be from 0.01% to 0.10%.

The upper limit of Si is preferably 0.09%, and is more preferably 0.08%, whereas the lower limit of Si is preferably 0.02%, and is more preferably 0.03%.

Fe and Co

Fe and Co are effective for preventing forging cracking by improving toughness in a temperature range of 1200° C. or more. This effect can be achieved when 0.05% or more of Fe is contained. However, if the content exceeds 1.00%, then the deformability at forging might decrease. Therefore, the Fe content is set to be from 0.05% to 1.00%.

The upper limit of Fe is preferably 0.90%, and is more preferably 0.80%, whereas the lower limit of Fe is preferably 0.07%, and is more preferably 0.10%.

Similarly, a comparable effect can be achieved when 0.01% or more of Co is contained. However, if the content exceeds 1.00%, then the effect might be saturated, and at the same time, a decrease in corrosion resistance against acids might be unfavorably caused. Therefore, the Co content is set to be from 0.01% to 1.00%.

The upper limit of Co is preferably 0.80%, and is more preferably 0.50%, whereas the lower limit of Co is preferably 0.02%, and is more preferably 0.05%.

Al and Ti

Al and Ti are added because they are effective for improving the hot forgeability. This is because Al and Ti combine with oxygen in molten metal, and then they float to the surface and are removed from the surface of the molten metal as slag, so that the oxygen in the metal can be removed. The deoxidation effect can be enhanced by adding Al and Ti at the same time, rather than adding them separately.

This effect can be achieved when 0.01% or more of Al is added. However, if the content exceeds 0.30%, then the incubation period for precipitation under a high temperature environment shifts to a shorter-time scale, resulting in an unfavorable increase in the possibility of forging cracking. Therefore, the Al content is set to be from 0.01% to 0.30%.

The upper limit of Al is preferably 0.26%, and is more preferably 0.20%, whereas the lower limit of Al is preferably 0.02%, and is more preferably 0.05%.

Similarly, a comparable effect can be achieved when 0.04% or more of Ti is added. However, if the content exceeds 0.30%, then the incubation period for precipitation under a high temperature environment shifts to a shorter-time scale, resulting in an unfavorable increase in the possibility of forging cracking particularly in the presence of coarse α-Cr phase. Therefore, the Ti content is set to be from 0.04% to 0.30%.

The upper limit of Ti is preferably 0.28%, and is more preferably 0.25%, whereas the lower limit of Ti is preferably 0.05%, and is more preferably 0.07%.

V

V is effective for reducing the occurrence of coarse α-Cr phase in a high temperature area, and thereby, in particular, the deformability regarding the hot forgeability can be improved, so that forging cracking can be suppressed. This effect can be achieved when 0.0003% or more of V is contained. However, if the content exceeds 0.0900%, then the deformability at a high temperature might decrease and the effect of suppressing forging cracking might disappear. Therefore, the V content is set to be from 0.0003% to 0.0900%.

The upper limit of V is preferably 0.0700%, and is more preferably 0.0500%, whereas the lower limit of V is preferably 0.0010%, and is more preferably 0.0050%.

Zr and B

Zr and B are effective for improving the deformability in hot forging in a temperature range of 1100° C. or more, in particular, 1200° C. or more, and thereby the cracking during hot forging can be reduced. In particular, it is effective for improving the hot forgeability in a state in which the coarse α-Cr phase, which is the solidified structure that has become obvious, is present. In this case, the effect achieved by combined addition of Zr and B can be greater than that achieved by adding them separately.

This effect can be achieved when 0.0001% or more of B is contained. However, if the content exceeds 0.0100%, then the concentration in grain boundaries might occur, so that the deformability might decrease, and accordingly, cracking during hot forging might be induced. Therefore, the B content is set to be from 0.0001 to 0.0100%.

The upper limit of B is preferably 0.0080%, and is more preferably 0.0050%, whereas the lower limit of B is preferably more than 0.0005%, and is more preferably 0.0010%.

Similarly, a comparable effect can be achieved when 0.001% or more of Zr is contained. However, if the content exceeds 0.050%, then concentration at grain boundaries might occur, so that deformability might decrease, and accordingly, cracking during hot forging might be induced. Therefore, the Zr content is set to be from 0.001 to 0.05%.

The upper limit of Zr is preferably 0.040%, and is more preferably 0.030%, whereas the lower limit of Zr is preferably 0.003%, and is more preferably 0.005%.

Ca

Since Cu is effective for improving corrosion resistance to acids, Cu may be added as necessary. This effect can be achieved when 0.001% or more of Cu is contained. However, if the content exceeds 0.020%, then the hot forgeability tends to decrease. Therefore, the Cu content is set to be from 0.001 to 0.020%.

The upper limit of Cu is preferably 0.015%, and is more preferably 0.010%, whereas the lower limit of Cu is preferably 0.002%, and is more preferably 0.005%.

W

Since W is effective for improving high temperature corrosion resistance, W may be added as necessary. This effect can be achieved when 0.001% or more of W is contained. However, if the content exceeds 0.100%, then the hot forgeability tends to decrease. Therefore, the W content is set to be from 0.001 to 0.100%.

The upper limit of W is preferably 0.090%, and is more preferably 0.080%, whereas the lower limit of W is preferably 0.002%, and is more preferably 0.005%.

Ca

Ca is effective for reducing forging cracking by improving deformability in hot forgeability at, in particular, 1200° C. or more, in a state in which the coarse α-Cr phase, which is the solidified structure that has become obvious, is present, and thus, Ca may be added as necessary. This effect can be achieved when 0.0001% or more of Ca is contained. However, if the content is 0.0020% or more, then the deformability might decrease, so that cracking might be induced. Therefore, the Ca content is set to be 0.0001% or more and less than 0.0020%.

The upper limit of Ca is preferably 0.0019%, and is more preferably 0.0017%, whereas the lower limit of Ca is preferably 0.0002%, and is more preferably 0.0005%.

Nb

Nb is effective for improving the hot workability at 900° C. or less, by reducing formation of $M_{23}C_6$ carbide by forming NbC, and thus, Nb may be added as necessary. This effect can be achieved when 0.001% or more of Nb is contained. However, if the content is 0.100% or more, then the precipitation of α-Cr phase might be unfavorably promoted. Therefore, the Nb content is set to be 0.001% or more and less than 0.100%.

The upper limit of Nb is preferably 0.090%, and is more preferably 0.080%, whereas the lower limit of Nb is preferably 0.002%, and is more preferably 0.005%.

Inevitable Impurities

Although it is inevitable that P, S, Sn, Zn, Pb and C are contained as dissolved raw materials, less than 0.01% of P, less than 0.01% of S, less than 0.01% of Sn, less than 0.01% of Zn, less than 0.002% of Pb, and less than 0.01% of C do not impair the properties of the alloy of the present invention, and thus, these constituent elements with the contents thereof within the ranges described above are permitted.

Hereunder, examples of the present invention will be described.

EXAMPLES

Example 1

Each of the Ni-based alloys having predetermined component compositions was melted using a general vacuum high-frequency melting furnace, and was formed into about 15 kg of a cylindrical ingot of 10 mm diameter×240 mm.

On an outer surface of the mold used to form the ingot, a Kanthal heating element was placed, thereby the maximum temperature of 1400° C. could be maintained, and a target temperature to be maintained could be varied by a thermoregulator. Thus, a solidified structure that mimics a large ingot can be obtained.

After tapping, the temperature was maintained at 1325° C., which is within the temperature range in which a solid phase and a liquid phase coexist, for 60 min, and the temperature was decreased at a cooling rate of 2° C./min, and then, when the temperature became less than 500° C., the heater was turned off to let it cool naturally.

The obtained ingots were subjected to a homogenizing heat treatment at 1230° C. for 1 hours, and then, the ingots were cooled by water, to form high-Cr-containing Ni-based alloys 1 to 42 of the present invention shown in Tables 1 to 3, Comparative high-Cr-containing Ni-based alloys 1 to 26 shown in Tables 4 and 5, and Conventional high-Cr-containing Ni-based alloys 1 to 3 shown in Table 6.

Since, in an upper end portion, shrinkage cavities occur in the casting process, a portion with the shrinkage cavities (about 4 kg from the upper surface) was cut off and removed.

Note that Conventional high-Cr-containing Ni-based alloy 1 corresponds to an alloy disclosed in Patent Document 1 ("corrosion-resistant Ni—Cr-based alloy having superior bend formability"), Conventional high-Cr-containing Ni-based alloy 2 corresponds to an alloy disclosed in Patent Document 3 ("Ni-based alloy having superior high temperature workability and having superior corrosion resistance with a significantly small elution amount of metal ions"), and Conventional high-Cr-containing Ni-based alloy 3 corresponds to an alloy disclosed in Patent Document 4 ("Ni-based alloy anti-corrosion plate having superior high-temperature corrosion resistance").

Furthermore, in order to perform evaluations described below, material preparations were carried out. That is, for high-Cr-containing Ni-based alloys 1 to 42 of the present invention, Comparative high-Cr-containing Ni-based alloys 1 to 26, and Conventional high-Cr-containing Ni-based alloys 1 to 3, one round bar of 80 mm diameter×200 mm and three round bars of 15 mm diameter×200 mm were subsequently cut from each ingot by wire-cut electrical discharge machining.

TABLE 1

| Present invention alloy No. | Composition | | | | | | | | | | | | | | | | | |
|---|---|---|---|---|---|---|---|---|---|---|---|---|---|---|---|---|---|---|
| | Cr | Mo | Mg | N | Mn | Si | Fe | Co | Al | Ti | V | B | Zr | Cu | W | Ca | Nb | Ni + inevitable impurities |
| 1 | 44.2 | 1.0 | 0.0026 | 0.019 | 0.9 | 0.02 | 0.74 | 0.46 | 0.05 | 0.28 | 0.0472 | 0.0062 | 0.007 | — | — | — | — | balance |
| 2 | 43.1 | 0.8 | 0.0040 | 0.013 | 0.22 | 0.09 | 0.24 | 0.12 | 0.09 | 0.20 | 0.0100 | 0.0024 | 0.014 | — | — | — | — | balance |
| 3 | 45.5 | 1.4 | 0.0043 | 0.014 | 0.28 | 0.08 | 0.52 | 0.58 | 0.18 | 0.13 | 0.0174 | 0.0075 | 0.005 | — | — | — | — | balance |
| 4 | 43.7 | 0.5 | 0.0015 | 0.015 | 0.13 | 0.05 | 0.65 | 0.64 | 0.26 | 0.23 | 0.0069 | 0.0037 | 0.016 | — | — | — | — | balance |
| 5 | 44.6 | 1.5 | 0.0045 | 0.024 | 0.26 | 0.07 | 0.08 | 0.75 | 0.14 | 0.17 | 0.0522 | 0.0025 | 0.038 | — | — | — | — | balance |
| 6 | 43.8 | 1.2 | 0.0001 | 0.025 | 0.09 | 0.06 | 0.54 | 0.18 | 0.15 | 0.24 | 0.0106 | 0.0009 | 0.020 | — | — | — | — | balance |
| 7 | 44.3 | 1.3 | 0.0088 | 0.031 | 0.16 | 0.07 | 0.66 | 0.39 | 0.18 | 0.21 | 0.0338 | 0.0018 | 0.017 | — | — | — | — | balance |
| 8 | 43.8 | 0.9 | 0.0017 | 0.001 | 0.13 | 0.08 | 0.11 | 0.19 | 0.10 | 0.16 | 0.0199 | 0.0009 | 0.030 | — | — | — | — | balance |
| 9 | 44.7 | 0.8 | 0.0008 | 0.039 | 0.29 | 0.04 | 0.09 | 0.22 | 0.10 | 0.11 | 0.0022 | 0.0052 | 0.015 | — | — | — | — | balance |
| 10 | 44.6 | 1.3 | 0.0015 | 0.013 | 0.05 | 0.06 | 0.61 | 0.70 | 0.24 | 0.07 | 0.0654 | 0.0008 | 0.019 | — | — | — | — | balance |
| 11 | 44.7 | 1.0 | 0.0016 | 0.019 | 0.49 | 0.03 | 0.42 | 0.64 | 0.24 | 0.20 | 0.0570 | 0.0053 | 0.005 | — | — | — | — | balance |
| 12 | 43.7 | 0.9 | 0.0020 | 0.012 | 0.33 | 0.01 | 0.45 | 0.17 | 0.07 | 0.10 | 0.0641 | 0.0031 | 0.003 | — | — | — | — | balance |
| 13 | 43.7 | 0.9 | 0.0050 | 0.033 | 0.34 | 0.09 | 0.13 | 0.64 | 0.21 | 0.12 | 0.0571 | 0.0067 | 0.019 | — | — | — | — | balance |
| 14 | 44.3 | 1.0 | 0.0049 | 0.015 | 0.13 | 0.03 | 0.05 | 0.23 | 0.20 | 0.14 | 0.0203 | 0.0024 | 0.031 | — | — | — | — | balance |

TABLE 2

| Present invention alloy No. | Composition | | | | | | | | | | | | | | | | | |
|---|---|---|---|---|---|---|---|---|---|---|---|---|---|---|---|---|---|---|
| | Cr | Mo | Mg | N | Mn | Si | Fe | Co | Al | Ti | V | B | Zr | Cu | W | Ca | Nb | Ni + inevitable impurities |
| 15 | 44.8 | 0.8 | 0.0074 | 0.019 | 0.34 | 0.09 | 0.99 | 0.65 | 0.07 | 0.22 | 0.0564 | 0.0046 | 0.036 | — | — | — | — | balance |
| 16 | 44.0 | 1.0 | 0.0068 | 0.030 | 0.25 | 0.03 | 0.84 | 0.01 | 0.05 | 0.20 | 0.0069 | 0.0060 | 0.010 | — | — | — | — | balance |
| 17 | 44.2 | 0.8 | 0.0014 | 0.030 | 0.10 | 0.04 | 0.18 | 0.98 | 0.22 | 0.23 | 0.0421 | 0.0024 | 0.003 | — | — | — | — | balance |
| 18 | 45.0 | 1.2 | 0.0039 | 0.027 | 0.21 | 0.03 | 0.71 | 0.57 | 0.01 | 0.23 | 0.0346 | 0.0006 | 0.006 | — | — | — | — | balance |
| 19 | 44.9 | 1.2 | 0.0053 | 0.028 | 0.14 | 0.08 | 0.32 | 0.37 | 0.29 | 0.10 | 0.0474 | 0.0064 | 0.024 | — | — | — | — | balance |
| 20 | 44.3 | 1.2 | 0.0046 | 0.007 | 0.22 | 0.07 | 0.25 | 0.23 | 0.24 | 0.04 | 0.0339 | 0.0047 | 0.019 | — | — | — | — | balance |
| 21 | 44.5 | 0.8 | 0.0050 | 0.026 | 0.12 | 0.05 | 0.28 | 0.56 | 0.14 | 0.29 | 0.0509 | 0.0024 | 0.019 | — | — | — | — | balance |
| 22 | 44.7 | 1.1 | 0.0049 | 0.020 | 0.37 | 0.07 | 0.68 | 0.42 | 0.18 | 0.12 | 0.0003 | 0.0006 | 0.037 | — | — | — | — | balance |
| 23 | 44.6 | 1.2 | 0.0008 | 0.020 | 0.17 | 0.08 | 0.70 | 0.05 | 0.14 | 0.14 | 0.0897 | 0.0012 | 0.015 | — | — | — | — | balance |
| 24 | 43.5 | 0.9 | 0.0057 | 0.021 | 0.16 | 0.03 | 0.34 | 0.69 | 0.06 | 0.10 | 0.0555 | 0.0001 | 0.012 | — | — | — | — | balance |
| 25 | 43.7 | 0.8 | 0.0025 | 0.011 | 0.29 | 0.04 | 0.84 | 0.74 | 0.17 | 0.18 | 0.0251 | 0.0098 | 0.010 | — | — | — | — | balance |
| 26 | 43.6 | 1.2 | 0.0058 | 0.021 | 0.33 | 0.06 | 0.68 | 0.36 | 0.10 | 0.11 | 0.0016 | 0.0058 | 0.001 | — | — | — | — | balance |
| 27 | 44.3 | 0.9 | 0.0049 | 0.022 | 0.27 | 0.06 | 0.21 | 0.24 | 0.08 | 0.07 | 0.0254 | 0.0030 | 0.049 | — | — | — | — | balance |

TABLE 3

| Present invention alloy No. | Composition | | | | | | | | | | | | | | | | | |
|---|---|---|---|---|---|---|---|---|---|---|---|---|---|---|---|---|---|---|
| | Cr | Mo | Mg | N | Mn | Si | Fe | Co | Al | Ti | V | B | Zr | Cu | W | Ca | Nb | Ni + inevitable impurities |
| 28 | 43.9 | 1.1 | 0.0013 | 0.003 | 0.27 | 0.07 | 0.11 | 0.30 | 0.07 | 0.19 | 0.0286 | 0.0046 | 0.019 | 0.001 | — | — | — | balance |
| 29 | 44.3 | 1.3 | 0.0060 | 0.033 | 0.26 | 0.03 | 0.36 | 0.46 | 0.19 | 0.27 | 0.0560 | 0.0007 | 0.033 | 0.019 | — | — | — | balance |
| 30 | 44.6 | 1.3 | 0.0007 | 0.033 | 0.22 | 0.07 | 0.43 | 0.51 | 0.25 | 0.17 | 0.0280 | 0.0028 | 0.018 | — | 0.001 | — | — | balance |
| 31 | 43.9 | 1.3 | 0.0055 | 0.016 | 0.09 | 0.06 | 0.49 | 0.75 | 0.15 | 0.18 | 0.0381 | 0.0046 | 0.021 | — | 0.098 | — | — | balance |
| 32 | 44.1 | 1.2 | 0.0077 | 0.010 | 0.17 | 0.07 | 0.18 | 0.45 | 0.16 | 0.27 | 0.0490 | 0.0019 | 0.009 | 0.012 | 0.035 | — | — | balance |
| 33 | 44.0 | 1.2 | 0.0076 | 0.016 | 0.12 | 0.06 | 0.12 | 0.69 | 0.08 | 0.23 | 0.0630 | 0.0006 | 0.034 | — | — | 0.0001 | — | balance |
| 34 | 44.2 | 1.4 | 0.0080 | 0.014 | 0.27 | 0.07 | 0.22 | 0.51 | 0.20 | 0.13 | 0.0170 | 0.0024 | 0.023 | — | — | 0.0019 | — | balance |
| 35 | 44.5 | 1.2 | 0.0034 | 0.017 | 0.16 | 0.02 | 0.50 | 0.71 | 0.08 | 0.22 | 0.0493 | 0.0038 | 0.023 | — | — | — | 0.001 | balance |
| 36 | 44.7 | 1.3 | 0.0076 | 0.022 | 0.12 | 0.07 | 0.72 | 0.31 | 0.19 | 0.06 | 0.0478 | 0.0018 | 0.025 | — | — | — | 0.098 | balance |
| 37 | 44.8 | 1.3 | 0.0027 | 0.002 | 0.22 | 0.05 | 0.13 | 0.51 | 0.23 | 0.07 | 0.0102 | 0.0013 | 0.012 | — | — | — | 0.055 | balance |
| 38 | 44.7 | 1.2 | 0.0047 | 0.023 | 0.33 | 0.06 | 0.79 | 0.49 | 0.03 | 0.14 | 0.0354 | 0.0046 | 0.029 | 0.007 | — | 0.0008 | 0.037 | balance |
| 39 | 44.1 | 0.8 | 0.0068 | 0.025 | 0.22 | 0.07 | 0.29 | 0.39 | 0.17 | 0.16 | 0.0651 | 0.0074 | 0.014 | — | 0.041 | 0.0012 | 0.018 | balance |
| 40 | 44.5 | 1.1 | 0.0003 | 0.035 | 0.28 | 0.03 | 0.82 | 0.65 | 0.17 | 0.13 | 0.0371 | 0.0053 | 0.011 | 0.011 | 0.025 | 0.0016 | 0.005 | balance |
| 41 | 44.2 | 0.9 | 0.0015 | 0.010 | 0.39 | 0.04 | 0.57 | 0.06 | 0.02 | 0.16 | 0.0287 | 0.0072 | 0.023 | 0.014 | — | — | 0.013 | balance |
| 42 | 44.5 | 1.1 | 0.0060 | 0.011 | 0.20 | 0.07 | 0.39 | 0.45 | 0.09 | 0.19 | 0.0306 | 0.0025 | 0.009 | 0.006 | — | — | 0.004 | balance |

TABLE 4

| Comparative alloy No. | Composition | | | | | | | | | | | | | | | | | |
|---|---|---|---|---|---|---|---|---|---|---|---|---|---|---|---|---|---|---|
| | Cr | Mo | Mg | N | Mn | Si | Fe | Co | Al | Ti | V | B | Zr | Cu | W | Ca | Nb | Ni + inevitable impurities |
| 1 | 42.8* | 1.0 | 0.0060 | 0.019 | 0.12 | 0.08 | 0.16 | 0.44 | 0.26 | 0.11 | 0.040 | 0.0076 | 0.022 | — | — | — | — | balance |
| 2 | 45.7* | 0.8 | 0.0034 | 0.013 | 0.17 | 0.02 | 0.60 | 0.33 | 0.10 | 0.16 | 0.038 | 0.0036 | 0.038 | — | — | — | — | balance |
| 3 | 44.9 | 0.4* | 0.0012 | 0.014 | 0.28 | 0.05 | 0.73 | 0.54 | 0.02 | 0.15 | 0.042 | 0.0011 | 0.007 | — | — | — | — | balance |
| 4 | 43.9 | 1.6* | 0.0039 | 0.015 | 0.39 | 0.02 | 0.61 | 0.48 | 0.08 | 0.19 | 0.015 | 0.0009 | 0.009 | — | — | — | — | balance |
| 5 | 44.8 | 0.7 | —* | 0.024 | 0.25 | 0.04 | 0.82 | 0.50 | 0.12 | 0.06 | 0.067 | 0.0075 | 0.033 | — | — | — | — | balance |
| 6 | 44.9 | 1.0 | 0.0108* | 0.025 | 0.39 | 0.05 | 0.52 | 0.29 | 0.21 | 0.15 | 0.012 | 0.0013 | 0.034 | — | — | — | — | balance |
| 7 | 44.4 | 0.8 | 0.0044 | —* | 0.33 | 0.05 | 0.23 | 0.08 | 0.19 | 0.12 | 0.050 | 0.0040 | 0.029 | — | — | — | — | balance |
| 8 | 44.7 | 1.2 | 0.0053 | 0.045* | 0.14 | 0.06 | 0.27 | 0.30 | 0.08 | 0.13 | 0.015 | 0.0044 | 0.020 | — | — | — | — | balance |
| 9 | 43.9 | 1.3 | 0.0066 | 0.010 | —* | 0.06 | 0.70 | 0.23 | 0.04 | 0.12 | 0.025 | 0.0077 | 0.035 | — | — | — | — | balance |
| 10 | 44.5 | 0.7 | 0.0037 | 0.013 | 0.54* | 0.03 | 0.16 | 0.53 | 0.09 | 0.14 | 0.052 | 0.0059 | 0.015 | — | — | — | — | balance |
| 11 | 43.9 | 1.1 | 0.0059 | 0.019 | 0.25 | —* | 0.60 | 0.58 | 0.10 | 0.21 | 0.029 | 0.0074 | 0.032 | — | — | — | — | balance |
| 12 | 43.7 | 1.4 | 0.0006 | 0.012 | 0.33 | 0.11* | 0.54 | 0.47 | 0.12 | 0.26 | 0.066 | 0.0050 | 0.007 | — | — | — | — | balance |
| 13 | 44.5 | 1.4 | 0.0060 | 0.033 | 0.33 | 0.07 | —* | 0.28 | 0.08 | 0.26 | 0.068 | 0.0033 | 0.029 | — | — | — | — | balance |
| 14 | 43.7 | 1.0 | 0.0038 | 0.015 | 0.17 | 0.08 | 1.11* | 0.11 | 0.16 | 0.20 | 0.012 | 0.0022 | 0.011 | — | — | — | — | balance |
| 15 | 43.9 | 1.2 | 0.0033 | 0.019 | 0.31 | 0.07 | 0.23 | —* | 0.16 | 0.12 | 0.021 | 0.0048 | 0.009 | — | — | — | — | balance |
| 16 | 44.2 | 1.0 | 0.0009 | 0.030 | 0.17 | 0.07 | 0.72 | 1.14* | 0.10 | 0.23 | 0.014 | 0.0054 | 0.035 | — | — | — | — | balance |

Asterisk (*) indicates out of range of composition of present invention.

TABLE 5

| Comparative alloy No. | Composition | | | | | | | | | | | | | | | | | |
|---|---|---|---|---|---|---|---|---|---|---|---|---|---|---|---|---|---|---|
| | Cr | Mo | Mg | N | Mn | Si | Fe | Co | Al | Ti | V | B | Zr | Cu | W | Ca | Nb | Ni + inevitable impurities |
| 17 | 43.9 | 1.2 | 0.0023 | 0.030 | 0.19 | 0.06 | 0.75 | 0.72 | —* | 0.22 | 0.032 | 0.0025 | 0.020 | — | — | — | — | balance |
| 18 | 44.0 | 0.9 | 0.0058 | 0.027 | 0.31 | 0.03 | 0.25 | 0.16 | 0.32* | 0.06 | 0.027 | 0.0009 | 0.033 | — | — | — | — | balance |
| 19 | 43.9 | 1.3 | 0.0060 | 0.028 | 0.31 | 0.04 | 0.25 | 0.15 | 0.06 | 0.03* | 0.064 | 0.0033 | 0.040 | — | — | — | — | balance |
| 20 | 43.7 | 0.8 | 0.0044 | 0.007 | 0.18 | 0.08 | 0.52 | 0.55 | 0.16 | 0.33* | 0.044 | 0.0020 | 0.025 | — | — | — | — | balance |
| 21 | 44.3 | 1.1 | 0.0066 | 0.026 | 0.12 | 0.08 | 0.54 | 0.77 | 0.18 | 0.12 | —* | 0.0017 | 0.006 | — | — | — | — | balance |
| 22 | 43.8 | 1.1 | 0.0058 | 0.020 | 0.13 | 0.02 | 0.73 | 0.47 | 0.06 | 0.06 | 0.11* | 0.0074 | 0.007 | — | — | — | — | balance |
| 23 | 44.9 | 1.0 | 0.0053 | 0.020 | 0.12 | 0.09 | 0.61 | 0.74 | 0.12 | 0.24 | 0.067 | —* | 0.028 | — | — | — | — | balance |
| 24 | 45.0 | 0.8 | 0.0055 | 0.021 | 0.08 | 0.03 | 0.25 | 0.77 | 0.11 | 0.08 | 0.051 | 0.0121* | 0.035 | — | — | — | — | balance |
| 25 | 44.8 | 0.9 | 0.0043 | 0.011 | 0.14 | 0.05 | 0.46 | 0.71 | 0.10 | 0.11 | 0.012 | 0.0053 | —* | — | — | — | — | balance |
| 26 | 43.6 | 0.8 | 0.0011 | 0.021 | 0.33 | 0.08 | 0.08 | 0.38 | 0.17 | 0.12 | 0.007 | 0.0039 | 0.055* | — | — | — | — | balance |

Asterisk (*) indicates out of range of composition of present invention.

TABLE 6

| Conventional alloy No. | Composition | | | | | | | | | | | | | | | | | |
|---|---|---|---|---|---|---|---|---|---|---|---|---|---|---|---|---|---|---|
| | Cr | Mo | Mg | N | Mn | Si | Fe | Co | Al | Ti | V | B | Zr | Cu | W | Ca | Nb | C | Ni + inevitable impurities |
| 1 | 44.2 | 1.0 | — | 0.021 | — | — | — | — | — | — | — | — | — | — | 0.27 | — | — | 0.014 | balance |
| 2 | 44.1 | 0.93 | 0.002 | 0.019 | 0.06 | 0.04 | 0.10 | — | — | — | — | — | — | — | — | — | — | 0.02 | balance |
| 3 | 44.5 | 0.9 | 0.001 | — | 0.13 | 0.06 | 0.32 | — | 0.018 | 0.0022 | 0.010 | — | — | — | — | — | — | 0.05 | balance |

(1) Hot Forging Test

The round bar of 80 mm diameter×200 mm of each of the high-Cr-containing Ni-based alloys 1 to 42 of the present invention, Comparative high-Cr-containing Ni-based alloys 1 to 26, and Conventional high-Cr-containing Ni-based alloys 1 to 3 was heated at 1230° C. in an air atmosphere furnace, and after being retained for 1 hours, the bar was taken out from the furnace, followed by hot forging with a hammer while tightening with a tap in the range of from 900° C. to 1230° C.

In the middle of the forging, the temperature might decrease below 900° C. before obtaining a predetermined shape. At that time, the bar was heated again in the furnace at 1230° C., retained for 15 min, followed by the hot forging.

The reheating in the furnace at 1230° C. and the hot forging were repeated several times, and finally, three bars of 20 mm diameter×1000 mm were formed.

Alloys with significant cracks occurred in this process (hereinafter, referred to as "forged cracked product") are indicated in Tables 7 to 12 as "present", that is, the cracks were present after forging, and such alloys were not used in the evaluation described later.

Each of the remaining alloys without any problems occurring in the hot forging was retained at 1230° C. for 30 minutes, followed by being cooled with water, and thereby a solution heat treated material was obtained.

(2) Evaluation for Hot Forgeability

From the round bars of 15 mm diameter×200 mm cut from the ingots of the high-Cr-containing Ni-based alloys 1 to 42 of the present invention, Comparative high-Cr-containing Ni-based alloys 1 to 26, and Conventional high-Cr-containing Ni-based alloys 1 to 3, round-bar tensile specimens (68 mm in total length; parallel portion having a diameter of 6 mm, a length of 15 mm) were formed.

These tensile specimens were subjected to a high speed tensile tests under a high temperature mimicking forging conditions.

Thus, only the specimens were heated at 1230° C. by direct electrification, retained for 15 minutes, and then the specimens were subjected to a tensile test at high speed at 30 mm/sec.

After occurrence of a fracture, the diameter at the site of the fracture was measured, reduction of area in high speed tensile test (reduction of area $\delta=100\ (d\times d-d'\times d')/(d\times d)$ (%), where d is a diameter before testing, d' is a diameter after testing) was calculated, and the results are shown in Tables 7 to 12.

The reduction of area in the high speed tensile test can be an index for determining the deformability in a high temperature environment. In general, when assuming a large ingot, it is necessary to have a reduction of area of 60% or more.

(3) Corrosion Test

From the round bars having a diameter of 20 mm (solution heat treated materials) of the high-Cr-containing Ni-based alloys 1 to 42 of the present invention and Comparative high-Cr-containing Ni-based alloys 1 to 26 (except for the forged cracked products), plates of 20 mm diameter×3 mm were obtained by cutting, the entire surfaces of these plates were polished and finished with waterproof emery paper #1000, so that corrosion specimens were obtained.

Here, since Conventional high-Cr-containing Ni-based alloys 1-3 were cracked in the forging process of the bars of 80 mm diameter×200 mm, the bars of 15 mm diameter×200 mm long were heated at 1230° C. in the air atmosphere furnace, retained for 10 hours, and then, the bars were taken out from the furnace, followed by hot rolling within the range of from 1000° C. to 1230° C. while pressing gradually. In the middle of the rolling, the temperature might decrease below 900° C. before obtaining a predetermined shape. At that time, the bars were heated again in the furnace at 1230° C., retained for 15 minutes, followed by hot rolling. The reheating in the furnace at 1230° C. and the hot forging were repeated several times, and finally, plates of 3 mm×20 mm×55 mm were obtained. From each of these plates, a plate of 20 mm diameter×3 mm was obtained by cutting, and the entire surface thereof was polished and finished with waterproof emery paper #1000, to form a corrosion specimen.

As a test for high temperature corrosion including sulfuration, the specimens were retained for 24 hours under a gas flow of $N_2$-40% $CO_2$-40% CO-0.1% $H_2S$, which was maintained at 800° C., and then a corrosion rate was calculated based on reduction amounts of weight, obtained from weights before and after testing.

In the measurement of the weight after testing, in order to remove scale produced by corrosion or oxidation, a removal method using an alkaline solution, known as the Gakushin-type, was adopted (the specimens were boiled in a solution of 18% NaOH+3% $KMnO_4$, and then boiled in an aqueous solution of 10% ammonium citrate. Both boiling processes were carried out for about 30 to 40 minutes). By using this method, the scale alone can be removed efficiently without causing damage to the ground metal.

The corrosion rate was calculated by the formula: corrosion rate (mm/year)=$\Delta W/(S\cdot t)\times 8.761/\rho$, where $\Delta W$ is a reduction amount of weight (g) before and after testing, S is a surface area of a specimen ($m^2$), t is a period of test (hours), $\rho$ is a specific gravity ($g/cm^3$). The specific gravity was obtained by the Archimedes method. Since the obtained specific gravities were mostly about 7.9 ($g/cm^2$), 7.9 ($g/cm^2$) was used in every calculation.

Furthermore, a corrosion test against acids was carried out as follows: a specimen was dipped in an aqueous solution of 5% $HNO_3$+50% $H_2SO_4$ and an aqueous solution of 50% $HNO_3$+2% HCl, which were maintained at 80° C., the specimen being dipped for 24 hours for each solution, and then, a corrosion rate was calculated based on a weight difference between weights before and after testing.

The results obtained from the tests described above are shown in Tables 7 to 12.

TABLE 7

| Present invention alloy No. | Presence of crack after forging | Reduction of area in high speed tensile test (%) | Corrosion test (mm/year) 800° C. reducing gas | 80° C. 50% $H_2SO_4$ + 5% $HNO_3$ | 80° C. 50% $HNO_3$ + 2% HCl |
|---|---|---|---|---|---|
| 1 | absent | 74 | 0.20 | 0.002 | 0.004 |
| 2 | absent | 81 | 0.31 | 0.004 | 0.007 |
| 3 | absent | 63 | 0.14 | 0.001 | 0.002 |
| 4 | absent | 72 | 0.21 | 0.002 | 0.004 |
| 5 | absent | 62 | 0.15 | 0.002 | 0.004 |
| 6 | absent | 71 | 0.27 | 0.002 | 0.005 |
| 7 | absent | 69 | 0.28 | 0.002 | 0.006 |
| 8 | absent | 66 | 0.23 | 0.002 | 0.002 |
| 9 | absent | 68 | 0.28 | 0.003 | 0.004 |
| 10 | absent | 65 | 0.13 | 0.001 | 0.004 |
| 11 | absent | 78 | 0.36 | 0.004 | 0.005 |
| 12 | absent | 64 | 0.17 | 0.002 | 0.002 |
| 13 | absent | 67 | 0.16 | 0.002 | 0.002 |
| 14 | absent | 65 | 0.15 | 0.002 | 0.003 |

TABLE 8

| Present invention alloy No. | Presence of crack after forging | Reduction of area in high speed tensile test (%) | Corrosion test (mm/year) 800° C. reducing gas | 80° C. 50% $H_2SO_4$ + 5% $HNO_3$ | 80° C. 50% $HNO_3$ + 2% HCl |
|---|---|---|---|---|---|
| 15 | absent | 82 | 0.38 | 0.005 | 0.006 |
| 16 | absent | 64 | 0.27 | 0.002 | 0.001 |
| 17 | absent | 79 | 0.12 | 0.005 | 0.006 |
| 18 | absent | 64 | 0.22 | 0.001 | 0.005 |
| 19 | absent | 62 | 0.17 | 0.002 | 0.003 |
| 20 | absent | 67 | 0.12 | 0.002 | 0.004 |
| 21 | absent | 64 | 0.23 | 0.003 | 0.002 |
| 22 | absent | 67 | 0.23 | 0.002 | 0.003 |
| 23 | absent | 63 | 0.28 | 0.001 | 0.004 |
| 24 | absent | 64 | 0.30 | 0.002 | 0.004 |
| 25 | absent | 62 | 0.28 | 0.004 | 0.003 |
| 26 | absent | 64 | 0.16 | 0.002 | 0.005 |
| 27 | absent | 63 | 0.22 | 0.003 | 0.006 |

TABLE 9

| Present invention alloy No. | Presence of crack after forging | Reduction of area in high speed tensile test (%) | Corrosion test (mm/year) 800° C. reducing gas | 80° C. 50% $H_2SO_4$ + 5% $HNO_3$ | 80° C. 50% $HNO_3$ + 2% HCl |
|---|---|---|---|---|---|
| 28 | absent | 62 | 0.38 | 0.003 | 0.004 |
| 29 | absent | 63 | 0.13 | 0.003 | 0.005 |
| 30 | absent | 67 | 0.21 | 0.003 | 0.005 |
| 31 | absent | 62 | 0.21 | 0.002 | 0.004 |
| 32 | absent | 61 | 0.21 | 0.004 | 0.004 |
| 33 | absent | 78 | 0.30 | 0.003 | 0.005 |
| 34 | absent | 76 | 0.13 | 0.002 | 0.003 |
| 35 | absent | 74 | 0.29 | 0.003 | 0.005 |
| 36 | absent | 67 | 0.13 | 0.004 | 0.005 |
| 37 | absent | 81 | 0.14 | 0.002 | 0.006 |
| 38 | absent | 79 | 0.21 | 0.003 | 0.005 |
| 39 | absent | 83 | 0.30 | 0.003 | 0.005 |
| 40 | absent | 66 | 0.27 | 0.004 | 0.001 |
| 41 | absent | 78 | 0.29 | 0.002 | 0.004 |
| 42 | absent | 72 | 0.18 | 0.002 | 0.001 |

TABLE 10

| Comparative alloy No. | Presence of crack after forging | Reduction of area in high speed tensile test (%) | Corrosion test (mm/year) 800° C. reducing gas | 80° C. 50% $H_2SO_4$ + 5% $HNO_3$ | 80° C. 50% $HNO_3$ + 2% HCl |
|---|---|---|---|---|---|
| 1 | absent | 82 | 0.67 | 0.008 | 0.011 |
| 2 | present | — | — | — | — |
| 3 | absent | 84 | 0.13 | 0.011 | 0.008 |
| 4 | present | — | — | — | — |
| 5 | present | — | — | — | — |
| 6 | present | — | — | — | — |
| 7 | present | — | — | — | — |
| 8 | absent | 65 | 0.25 | 0.013 | 0.014 |
| 9 | present | — | — | — | — |
| 10 | absent | 72 | 0.13 | 0.021 | 0.016 |
| 11 | present | — | — | — | — |
| 12 | present | — | — | — | — |
| 13 | present | — | — | — | — |
| 14 | absent | 51 | 0.58 | 0.015 | 0.014 |
| 15 | present | — | — | — | — |
| 16 | absent | 67 | 0.34 | 0.021 | 0.022 |

TABLE 11

| Comparative alloy No. | Presence of crack after forging | Reduction of area in high speed tensile test (%) | Corrosion test (mm/year) 800° C. reducing gas | 80° C. 50% $H_2SO_4$ + 5% $HNO_3$ | 80° C. 50% $HNO_3$ + 2% HCl |
|---|---|---|---|---|---|
| 17 | present | — | — | — | — |
| 18 | present | — | — | — | — |
| 19 | present | — | — | — | — |
| 20 | present | — | — | — | — |
| 21 | present | — | — | — | — |
| 22 | absent | 52 | 0.21 | 0.004 | 0.008 |
| 23 | present | — | — | — | — |
| 24 | present | — | — | — | — |
| 25 | present | — | — | — | — |
| 26 | present | — | — | — | — |

TABLE 12

| Conventional alloy No. | Presence of crack after forging | Reduction of area in high speed tensile test (%) | Corrosion test (mm/year) 800° C. reducing gas | 80° C. 50% $H_2SO_4$ + 5% $HNO_3$ | 80° C. 50% $HNO_3$ + 2% HCl |
|---|---|---|---|---|---|
| 1 | present | — | 0.26 | 0.003 | 0.003 |
| 2 | present | — | 0.31 | 0.002 | 0.002 |
| 3 | present | — | 0.22 | 0.004 | 0.006 |

In view of the results shown above, it can be understood that the high-Cr-containing Ni-based alloys 1 to 42 of the present invention have superior corrosion resistance against high temperature corrosion and acids, equivalent to that of Conventional high-Cr-containing Ni-based alloy 1, Conventional high-Cr-containing Ni-based alloy 2 and Conventional high-Cr-containing Ni-based alloy 3, which are conventional materials.

Furthermore, it can be seen that the alloys 1 to 42 of the present invention have far superior hot forgeability even in a state in which coarse solidified structure is formed.

In contrast, as compared with the high-Cr-containing Ni-based alloys 1 to 42 of the present invention, Comparative high-Cr-containing Ni-based alloys 1 to 26, which are out of the range of the present invention, are inferior in corrosion resistance, or inferior in hot forgeability, so that the alloys were cracked during the hot forging process or had less reduction of area in the high speed tensile test (deformability (reduction of area)).

Example 2

An alloy having the same composition as that of the alloy 1 of the present invention, which was confirmed to have good hot forgeability, was subjected to 6-ton vacuum melting, which is on a mass production scale, and then poured into two 3-ton molds under a vacuum. One of them was melted again by an electro slag remelting (ESR). Thus, 3 tons of ingot of 520 mm diameter×1800 mm long was formed. This weight includes that of coarse α-Cr phase. The obtained ingot was subjected to a homogenizing heat treatment at 1230° C. for 10 hours, and was subsequently subjected to hot forging, to form a slab of 150 mm thick×600 mm×4000 mm. In the middle of the process, when the temperature decreased below 900° C., the ingot was heated again in the furnace, the temperature in which was maintained at 1230° C., and the hot forging was repeated until a predetermined size was obtained. As a result, no crack was found in the initial period of the forging process, and occurrence of cracking was not found after the end of the hot forging. Here, the occurrence of cracking in the initial period of forging was visually identified.

INDUSTRIAL APPLICABILITY

As described above, the high-Cr-containing Ni-based alloys of the present invention has superior hot forgeability, in particular, superior hot forgeability immediately after the beginning of hot forging of such a large ingot that includes a coarse α-Cr phase formed at solidification, and the alloys have superior corrosion resistance against hot temperature corrosion including sulfuration and superior corrosion resistance against acids, which are equivalent to or superior to those of conventional materials. Thus, by using the high-Cr-containing Ni-based alloy of the present invention, it becomes possible to manufacture a large forged member, for example, a slab (large forged product) having a size that can be provided in a manufacturing line for stainless steel, or a large forged member required in making a large reaction vessel.

Therefore, according to the high-Cr-containing Ni-based alloys of the present invention, a slab having a size that can be provided in a manufacturing line for stainless steel, or a large forged member required in making a large reaction vessel can be provided, and accordingly, the present invention demonstrates excellent industrial effects.

In addition, since the high-Cr-containing Ni-based alloys of the present invention has superior hot forgeability, products with complicated shapes can be easily formed, so that it is expected as a new material that can be applied in a new field.

The invention claimed is:

1. A heat-resistant and corrosion-resistant high-Cr-containing Ni-based alloy suitable for hot forgeability, the alloy having a composition consisting of, by mass %, 43.1% to 45.5% of Cr,
0.5% to 1.5% of Mo,
0.0001% to 0.0090% of Mg,
0.001% to 0.040% of N,
0.05% to 0.50% of Mn,
0.01% to 0.10% of Si,
0.05% to 1.00% of Fe,
0.01% to 1.00% of Co,
0.01% to 0.30% of Al,
0.04% to 0.3% of Ti,
0.0003% to 0.0900% of V,
0.0001% to 0.0100% of B,
0.001% to 0.050% of Zr,
optionally 0.001% to 0.020% of Cu,
optionally 0.001% to 0.100% of W,
optionally 0.0001% to less than 0.0020% of Ca,
optionally 0.001% to less than 0.100% of Nb, and
the balance of Ni with inevitable impurities.

2. A member for a boiler of a thermal power station for use in a waste gas environment, made of the heat-resistant and corrosion-resistant high-Cr-containing Ni-based alloy according to claim 1.

3. A member for a corrosion-resistant pressure vessel for use in a chemical plant, made of the heat-resistant and corrosion-resistant high-Cr-containing Ni-based alloy according to claim 1.

4. The heat-resistant and corrosion-resistant high-Cr-containing Ni-based alloy according claim 1, wherein niobium is present in an amount of 0.001% to less than 0.100% by mass %.

5. The heat-resistant and corrosion-resistant high-Cr-containing Ni-based alloy according to claim 1, wherein calcium is present in an amount of 0.0001% to less than 0.0020% by mass %.

6. The heat-resistant and corrosion-resistant high-Cr-containing Ni-based alloy according claim 5, wherein niobium is present in an amount of 0.001% or to less than 0.100% by mass %.

7. The heat-resistant and corrosion-resistant high-Cr-containing Ni-based alloy according to claim 1, wherein copper is present in an amount of 0.001% to 0.020% by mass %.

8. The heat-resistant and corrosion-resistant high-Cr-containing Ni-based alloy according claim 7, wherein niobium is present in an amount of 0.001% to less than 0.100% by mass %.

9. The heat-resistant and corrosion-resistant high-Cr-containing Ni-based alloy according to claim 7, wherein tungsten is present in an amount of 0.001% to 0.100% by mass %.

10. The heat-resistant and corrosion-resistant high-Cr-containing Ni-based alloy according to claim 9, wherein calcium is present in an amount of 0.0001% to less than 0.0020% by mass %.

11. The heat-resistant and corrosion-resistant high-Cr-containing Ni-based alloy according claim 10, wherein niobium is present in an amount of 0.001% to less than 0.100% by mass %.

12. The heat-resistant and corrosion-resistant high-Cr-containing Ni-based alloy according claim 9, wherein niobium is present in an amount of 0.001% to less than 0.100% by mass %.

13. The heat-resistant and corrosion-resistant high-Cr-containing Ni-based alloy according to claim 7, wherein calcium is present in an amount of 0.0001% to less than 0.0020% by mass %.

14. The heat-resistant and corrosion-resistant high-Cr-containing Ni-based alloy according claim 13, wherein niobium is present in an amount of 0.001% to less than 0.100% by mass %.

15. The heat-resistant and corrosion-resistant high-Cr-containing Ni-based alloy according to claim 1, wherein tungsten is present in an amount of 0.001% to 0.100% by mass %.

16. The heat-resistant and corrosion-resistant high-Cr-containing Ni-based alloy according to claim 15, wherein calcium is present in an amount of 0.0001% to less than 0.0020% by mass %.

17. The heat-resistant and corrosion-resistant high-Cr-containing Ni-based alloy according claim 16, wherein niobium is present in an amount of 0.001% to less than 0.100% by mass %.

18. The heat-resistant and corrosion-resistant high-Cr-containing Ni-based alloy according claim 15, wherein niobium is present in an amount of 0.001% to less than 0.100% by mass %.

* * * * *